United States Patent [19]

Vines

[11] 4,201,991

[45] May 6, 1980

[54] ANTENNA STRUCTURE ASSEMBLED FROM SEPARABLE PARTS

[75] Inventor: James K. Vines, Park Forest South, Ill.

[73] Assignee: Paraframe, Inc., Monee, Ill.

[21] Appl. No.: 887,354

[22] Filed: Mar. 16, 1978

[51] Int. Cl.[2] ..... H01Q 15/20; H01Q 19/12

[52] U.S. Cl. ..... 343/840; 343/915

[58] Field of Search ..... 343/840, 915, 878

[56] References Cited

U.S. PATENT DOCUMENTS

| | | | |
|---|---|---|---|
| 3,286,270 | 11/1966 | Kelly | 343/840 |
| 3,635,547 | 1/1972 | Rushing et al. | 343/915 |

FOREIGN PATENT DOCUMENTS

| | | | |
|---|---|---|---|
| 1180464 | 6/1959 | France | 343/915 |

*Primary Examiner*—Eli Lieberman

*Attorney, Agent, or Firm*—Richard G. Kinney

[57] ABSTRACT

An antenna structure, kit and method for making the structure comprising a generally circular base, a plurality of specially formed pre-stressed similarly shaped and sized arms which may be affixed in a disk array to the base and means, an arm encircling turnbuckel cable arrangement, for stressing the pre-stressed arms into a generally parabolic disk array is disclosed. The ribs are each made of a plurality of layers of resilient material, such as wood, which are bonded together in a bowed pre-stressed shape, which shape when modified by the stressing by the cable to assume a generally parabolic disk.

5 Claims, 4 Drawing Figures

ANTENNA STRUCTURE ASSEMBLED FROM SEPARABLE PARTS

FIELD OF THE INVENTION

The present invention is directed to a novel antenna structure, method and kit for making the antenna structure and is particularly concerned with the construction of the framework for a parabolic disk antenna.

BACKGROUND

It is known to make and use parabolic disk antenna for a number of applications. However, such antenna as are commercially available are relatively expensive and are often priced beyond the means of amateur radio astronomers or many people, such as those in isolated areas, who would wish to receive television or radio signals from satellite stations. For example, the antenna structure detailed in U.S. Pat. No. 2,985,881 is quite complex and would be too expensive for many individuals. Also many prior art antennae, such as that shown in U.S. Pat. No. 3,832,717, are usually constructed in such a manner as to require a permanent installation. While collapsable antennae have been suggested, e.g. U.S. Pat. No. 4,030,103, these tend to sacrifice performance by not being a full disk shape and tend to be relatively complex and expensive structures.

SUMMARY OF THE INVENTION

Against this background the present invention provides a structure that is relatively simple, can be in kit form for erection and disassembly for storage, and is economic and relatively simple to make and use.

An antenna constructed in accordance with the present invention includes a base to which are affixed a plurality of specially formed substantially similarly shaped and sized arms which radiate outward in a disk array. The arms are constructed so as to be pre-stressed, and each includes a plurality of originally separate layers of flat resilient material, such as wood, which layers are bent and bonded together in a bowed or curved arrangement to provide the pre-stressing. Means for tensioning or stressing the arms are provided which, when applied, cause the bowed arms to form into a generally parabolic shape. This latter means may be an encircling cable which is received at the outer ends of each of the arms and means, such as a turnbuckel, for tensioning the cable and thus for stressing the arms.

The invention, together with the advantages thereof, may best be understood by reference to the following description taken in connection with the accompanying drawings, in the several figures of which like reference numerals identify like elements.

DETAILED DESCRIPTION

Figure 1:
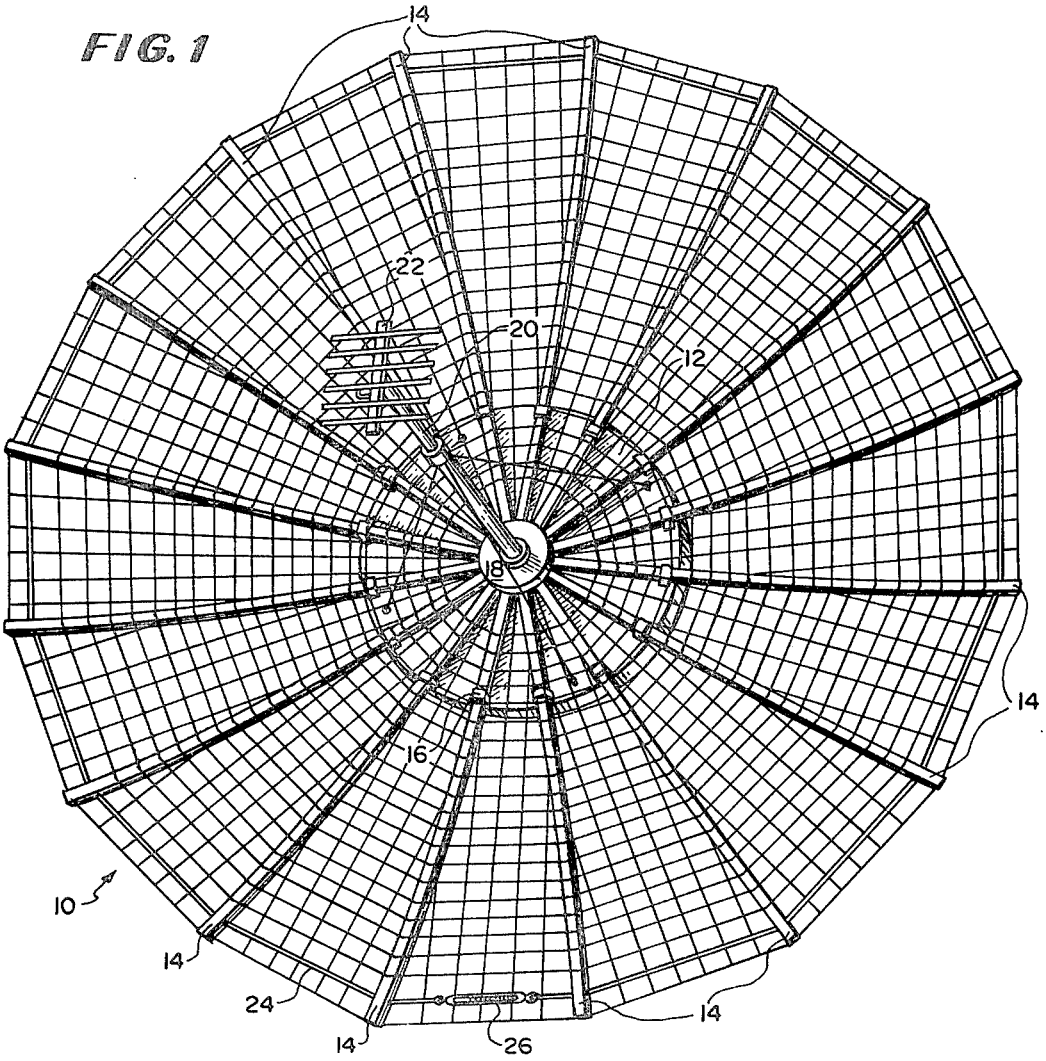
FIG. 1 is a perspective view of an antenna constructed in accordance with the present invention.

Refering now to FIG. 1, there is depicted an assembled antenna structure constructed in accordance with the principles of the present invention and generally designated by the number 10. The antenna 10 includes a generally circular vertex plate or base 12, a plurality, in this case 16, of specially constructed arms 14 which radiate outward from the base 12 to form a disk array. The arms 14 are affixed to the base 12 by means of a plurality of sleeve members 16 in which the arms 14 and a clamping plate 18 which sandwiches the internal ends of the arms 16 between itself and the base 12. Though the center of the base 12 and plate 18 is a hole for accomodating a feed boom assembly 20 including a feed antenna 22 at the focus of the disk, defined by the arms 14. Means for stressing the arms 14 include a cable 24 which is received by the external ends of the arms 14 (through sleeves provided therein) and encircles the assembly and a turnbuckel 26 for tensioning the cable 24 and stressing and forming the arms 14 into the desired generally parabolic shape with a parabolic focus at feed antenna 22.

Figure 2:
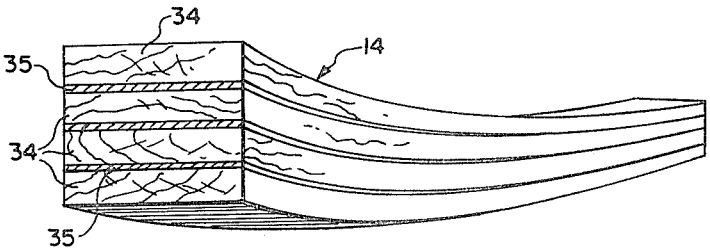
FIG. 2 is a sectional view of an arm of the antenna in FIG. 1.
Figure 3:
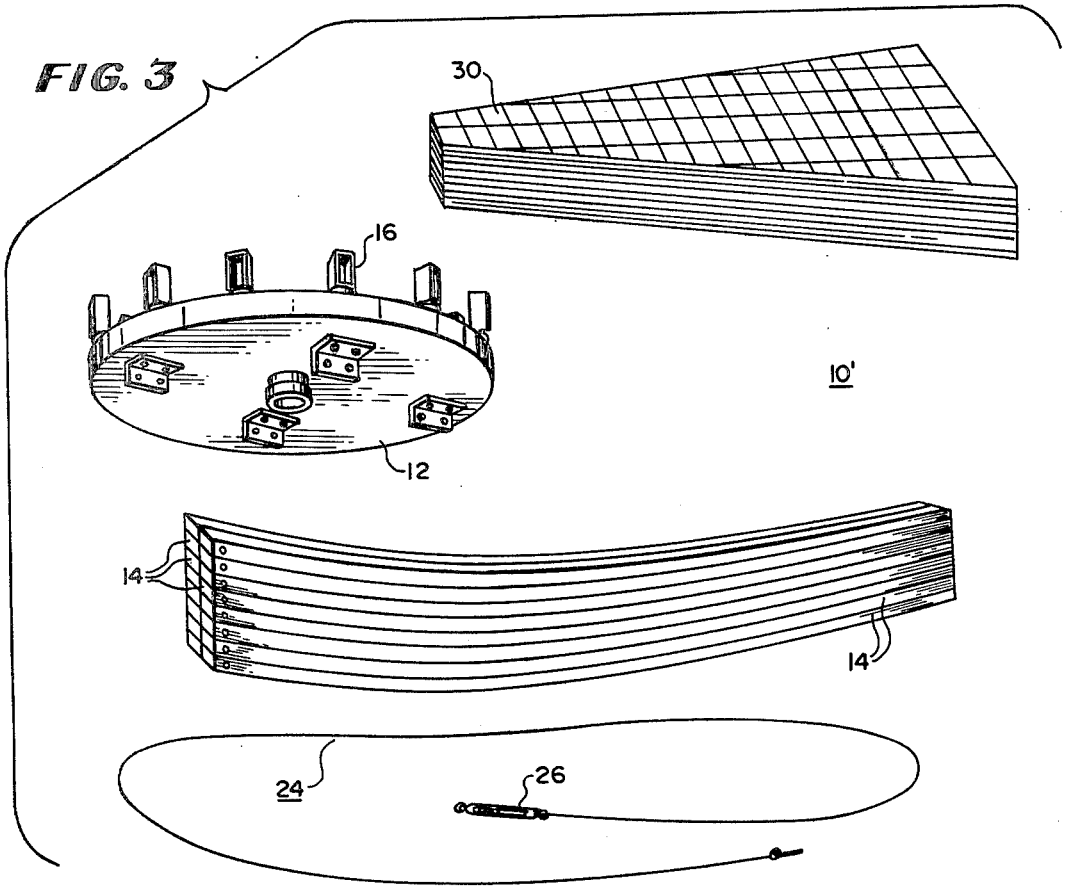
FIG. 3 is a perspective view of the arm of FIGS. 1 and 2 during different stages of construction.

More particularly the arms 14 are pre-stressed by being formed, as shown in FIGS. 2 and 3, of a plurality of layers 34 of resilient material such as wood bonded together in a bowed or curved arrangement. That is, each layer 34 is bonded by a suitable cement layer 35 to the arm below it. The arms are preferably formed by taking a plurality of layers 34, applying a slow drying cement 36 between them and then clamping the set of layers into a fixture which forces it to achieve the bowed or curved state and forces the layers into one another to assure the curved pre-stressed shape.

As shown in FIG. 3, the kit of parts 10' that can be employed are a set of substantially similar sized and shaped arms 14, base 12 with attaching means 16, 18 and tensioning means 24, 26. The kit may include radio wave relecting sheets 30 or these may be fabricated and supplied by the assembler.

Figure 4:
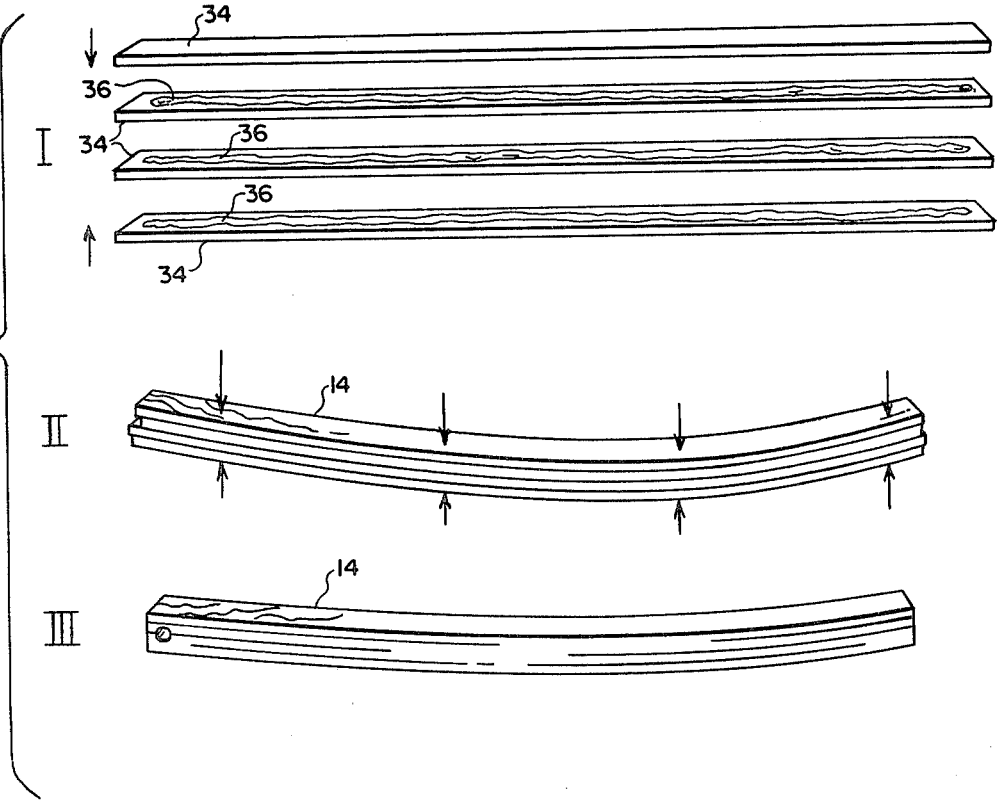
FIG. 4 is a perspective view of a kit of materials that may be used to assemble an antenna disk.

The method of constructing an arm 14 is shown in FIG. 4 wherein a plurality of normally flat elements 34 which are sized to the desired length of an arm 14, are sandwiched together with cement 36, e.g. marine epoxy, positioned between them and caused to assume a desired curvature as in (II) at the same time they are clamped together prior to the setting of the cement 36. This arrangement after finishing the outside and providing the whole receiving means yields the bowed arm 14 (III).

The shape of the finished pre-stressed arm 14 differs slightly from that of the captivated arm 14 of stage II and differs from that of the finished antenna (FIG. 1) such that the stressing or tension of the encircling cable results in a true parabolic shape.

As a concrete example, an antenna kit and antenna were constructed in accordance with the present invention with an overall size of 12 feet using antenna arms made of five layers 34 of white pine 1¼ inches wide and 7/16 inches thick, bonded with marine epoxy (such as Elmer's Waterproof Glue made by Borden Chemical Co.). The arms and layers were approximately 6 feet long.

The invention may be readily adapted to larger and smaller embodiments, however, which may use fewer or more arms 14. With increasing size the number of layers 34 are preferably increased; for example, six for a eight foot arm and seven layers for a ten foot arm.

In assembling the kit 10' of FIG. 4, one starts with the base 12, positions each of the sixteen arms 14 in place with the interior end between the plate and base, and passing through the sleeve. The sleeves are precisely positioned to help guide the arms to the right radial orientation. The assembler need only be sure that he puts the inside end into the base and has the arms bowing upward. The cable is then lead through the receiving means to encircle the arms attached to the turnbuckel. After checking and adjusting the alignment of the outer ends of the arms 14 (by for example, inserting a presized measuring elements between the ends of adjacent arms 14) the turnbuckel is tightened to stress the arms into the precise parabolic arrangement desired. At this point the framework is complete and the reflecting material may be secured. It need only be positioned between the arms and affixed in place. For a semi-permanent construction it need only be stapled in place as the wood construction of the arms 14 readily accepts staples. For a less permanent installation the reflector sections 30 may be affixed in any convient removable manner such as by wires twisted about the arms or removable screws or the like. The cable may be, for example, a vinyl coated ⅛ inch thick aircraft cable of 3600 pound breaking capacity. The screening 30 may be ordinary aluminum window screening but is preferably expanded aluminum (diamond mesh) or honeycomb perforated aluminum flat stock to withstand greater loading.

It should now be apparent that an extremely useful and advantageous antenna kit, structure and method of making the same has been described. The invention yields an economical result and is adaptable to a range of sizes and number of arms. The techniques illustrated may be easily adapted, for example, to 32 and 40 foot antenna. With increasing lengths of the arms the number of layers used and overall thickness is preferably increased. For example, 6 or 7 layers are used for arms of 8 and 10 feet, respectively.

The screening used in the panel 30 depends on the highest freguency anticipated for the frequency of transmission or broadcast. For example at 432 MHz ordinary chicken wire with a one inch opening will do. However, at 4 GHz a solid skin such as sheet metal is required. Expanded or perforated metal or welded wire fabric of appropriate sized perforations or openings can be used up to about 2.4 GHz to reduce wind loading or wieght or cost.

Although the base has been depicted as having a solid plate (preferable of wood) for larger sized antenna structures a base made of a metal ring is prefered. The base is prefered to be about at least 30% to 45% of the antenna aperture in diameter.

While one particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

I claim:

1. A structure for use in an antenna for receiving or broadcasting radio frequency signals, comprising, in combination:

a flat base;

a plurality of pre-stressed arms having an interior end and an exterior end, each of which arms is formed of a plurality of generally flat overlapping layers of resilient material permanently bonded to each other in a bowed configuration;

means for mounting the interior end of the arms to the base, so that the exterior ends are positioned in a radial array about the base; and cable means mounted about said arm ends for securing together said plurality of arms in a radiating array about the base together and for stressing the arms into a generally parabolic shape.

2. The structure as defined in claim 1 wherein a radio reflective cover is affixed to and between the arms to thereby form a generally parabolic reflective dish, and wherein each of said layers of resilient material of said arms is wood and said layers are bonded together by water-proof cement.

3. A kit for making a radio antenna comprising:

a base;

a plurality of means for affixing one end of arms to said base in a radial array;

a plurality of pre-stressed arms each of which has an interior end and an exterior end and each of which is formed of a plurality of layers of resilient material permanently bonded to each other in a bowed configuration, each of said arms being adapted for having its interior end affixed by said means for affixing to said base so that the arms may radiate therefrom in a dish array; and cable means for attaching to each of said arm ends when affixed to the base in a dish array and for stressing the pre-stressed arms so that they form a generally parabolic dish array.

4. The invention of claim 3 wherein said means for attachment includes a cable and turnbuckel whereby the cable may pass about and be received the external ends of each of said arms and the arm stressed by turning the turnbuckel.

5. The method for assembling parabolic dish antenna structure from a kit comprising, a base, a set of pre-stressed arms each of which have an interior and exterior end and each of which is formed of a plurality of layers of resilient material permanently bonded together in a bowed configuration, the base and arms having means for affixing the interior end of the arm to the base, and cable means for encircling the exterior ends of the arms and for captivating and stressing them, comprising the steps of:

(1) inserting and securing together the set of arms with their interior ends into the base so that the arms radiate from the base and are arranged so as to be concave in the same general direction to frame a disk-like shape;

(2) attaching the encircling, captivating and tensioning means about the exterior ends; and (3) tensioning the last named means, to stress and form the arms into a generally parabolic shape.

* * * * *